US007377955B1

(12) United States Patent
Shaw et al.

(10) Patent No.: US 7,377,955 B1
(45) Date of Patent: May 27, 2008

(54) METHOD AND APPARATUS FOR TREATMENT OF METALLURGICAL SLAG AND THE LIKE

(76) Inventors: Daniel Jonathan Shaw, Beaumont House, 47 Mount Pleasant, London, WC1X 0AE (GB); Rephael Fisch, Via Visconti di Modrone, 8/6, Milano, 20122 (IT)

( * ) Notice: Subject to any disclaimer, the term of this patent is extended or adjusted under 35 U.S.C. 154(b) by 0 days.

(21) Appl. No.: 10/416,559

(22) PCT Filed: Nov. 13, 2000

(86) PCT No.: PCT/GB00/04332

§ 371 (c)(1),
(2), (4) Date: May 12, 2003

(87) PCT Pub. No.: WO02/38816

PCT Pub. Date: May 16, 2002

(51) Int. Cl.
*C22B 5/20* (2006.01)
*B02C 19/00* (2006.01)

(52) U.S. Cl. ..... 75/414; 241/18; 241/23

(58) Field of Classification Search ..... 75/65, 75/10.53, 539, 751, 746, 770, 750, 749, 10.67; 241/23, 18
See application file for complete search history.

(56) References Cited

U.S. PATENT DOCUMENTS 2,971,703 A * 2/1961 Rath ..... 241/24.14
4,009,023 A * 2/1977 Oberg et al. ..... 75/10.17
4,046,323 A * 9/1977 McKerrow et al. ..... 241/23
6,015,448 A * 1/2000 Kaiser et al. ..... 75/560
6,189,818 B1 * 2/2001 Kunz et al. ..... 241/23
6,196,479 B1 * 3/2001 Edlinger ..... 241/1

FOREIGN PATENT DOCUMENTS

DE 195 19 284 C 8/1996
GB 327 732 A 4/1930
JP 62-292256 A * 12/1987
JP 8053705 * 2/1996

OTHER PUBLICATIONS

English abstract of JP 62-292256.*
International Search Report of PCT/BG 00/04332 mailed Jul. 13, 2001.
Patent Abstracts of Japan, vol. 007, No. 118 (C-167), May 21, 1983 & JP 58 039715 A (Sumitomo Kinzoku Kogyo KK), Mar. 8, 1983 abstract.
Patent Abstracts of Japan vol. 010, No. 318 (C-381), Oct. 29, 1986 & JP 61 127787 A (Ishikawajima Harima Heavy Ind Co Ltd), Jun. 16, 1986 abstract.

(Continued)

*Primary Examiner*—Roy King
*Assistant Examiner*—Tima M McGuthry-Banks
(74) *Attorney, Agent, or Firm*—Caesar, Rivise, Bernstein, Cohen & Pokotilow, Ltd.

(57) ABSTRACT

A substantially dry and dust free method of recovering ladle slag is allowing hot ladle slag to cool to powder form in a controlled environment and collecting the powder in a receiver therefor. A vessel having a chamber containing in an upper portion a screen through which ladle slag can pass into a receiver below and means for cooling the slag in the vessel are provided.

10 Claims, 4 Drawing Sheets

OTHER PUBLICATIONS

Database WPI Section Ch, Week 198219, Derwent Publications Ltd., London, GB; AN 1982-38109E XP002170861 & JP 57 055390 A (Nippon Steel Corp), Apr. 2, 1982 abstract.

International Search Report of PCT/BG 00/04332 mailed Jul. 13, 2001.

Patent Abstracts of Japan, vol. 007, No. 118 (C-167), May 21, 1983 & JP 58 039715 A (Sumitomo Kinzoku Kogyo KK), Mar. 8, 1983 abstract.

Patent Abstracts of Japan vol. 010, No. 318 (C-381), Oct. 29, 1986 & JP 61 127787 A (Ishikawajima Harima Heavy Ind Co Ltd), Jun. 16, 1986 abstract.

Database WPI Section Ch, Week 198219, Derwent Publications Ltd., London, GB; AN 1982-38109E XP002170861 & JP 57 055390 A (Nippon Steel Corp), Apr. 2, 1982 abstract.

* cited by examiner

METHOD AND APPARATUS FOR TREATMENT OF METALLURGICAL SLAG AND THE LIKE

The invention relates to the recovery of metallurgical slag.

Typically the slag residue from a ladle carrying liquid metal (steel) is rich in lime (typically circa 50%). Once the steel has been tapped from the ladle the slag residue which contains small amounts of metal (steel) is tipped into a pit by inverting the ladle. The tipped slag is extremely hot, at temperatures in excess of 500° C. The ladle slag cools rapidly in ambient conditions and normally reaches ambient temperature within 48 hours. When the ladle slag mass cools it crumbles to form a fine powder and this powder presents handling and environmental problems as it is dusty. Normally the slag is sprayed with water in a designated area to accelerate the cooling process and form a wet material which is not dusty to handle and transfer. The use of water causes the lime within the ladle slag to hydrate which substantially diminishes the potential value in reuse of this material as a lime substitute in the metallurgical (steelmaking) process. The use of water is also a negative environmental consideration.

It is an object of this invention to provide a method and means of recovering ladle slag for reuse which avoids the need to wet the slag. The invention is based on the realisation that if the slag is allowed or caused to cool and crumble in a controlled environment the resulting product is useable and the disadvantages of the current practices are eliminated.

According to the invention in one aspect there is provided a substantially dry and dust free method of recovering ladle slag, the method comprising allowing hot slag to cool to powder form in a controlled environment and to collect as powder into a receiver therefor.

Most preferably the slag is located on a screen or grid in the chamber of a vessel having a controlled atmosphere and the particles are allowed to fall into a receiver below.

Preferably the method includes the subsequent step of separating metal which is entrapped in the slag.

In another aspect the invention provides a vessel having a chamber containing in an upper portion a screen through which the ladle slag powder can pass into a receiver below and means for cooling the slag in the vessel.

Preferably the vessel is fully enclosed so avoiding the ingress of water entry and the escape of dust.

Preferably the vessel has controlled entry doors.

Other materials may be added to the ladle slag. Such materials include vacuum truck dust which is collected by vacuum technique around the metallurgical plant.

Other features of the invention are specified in the subclaims.

In order that the invention may be well understood it will now be described by way of example with reference to the accompanying diagrammatic drawings in which.

Figure 1:
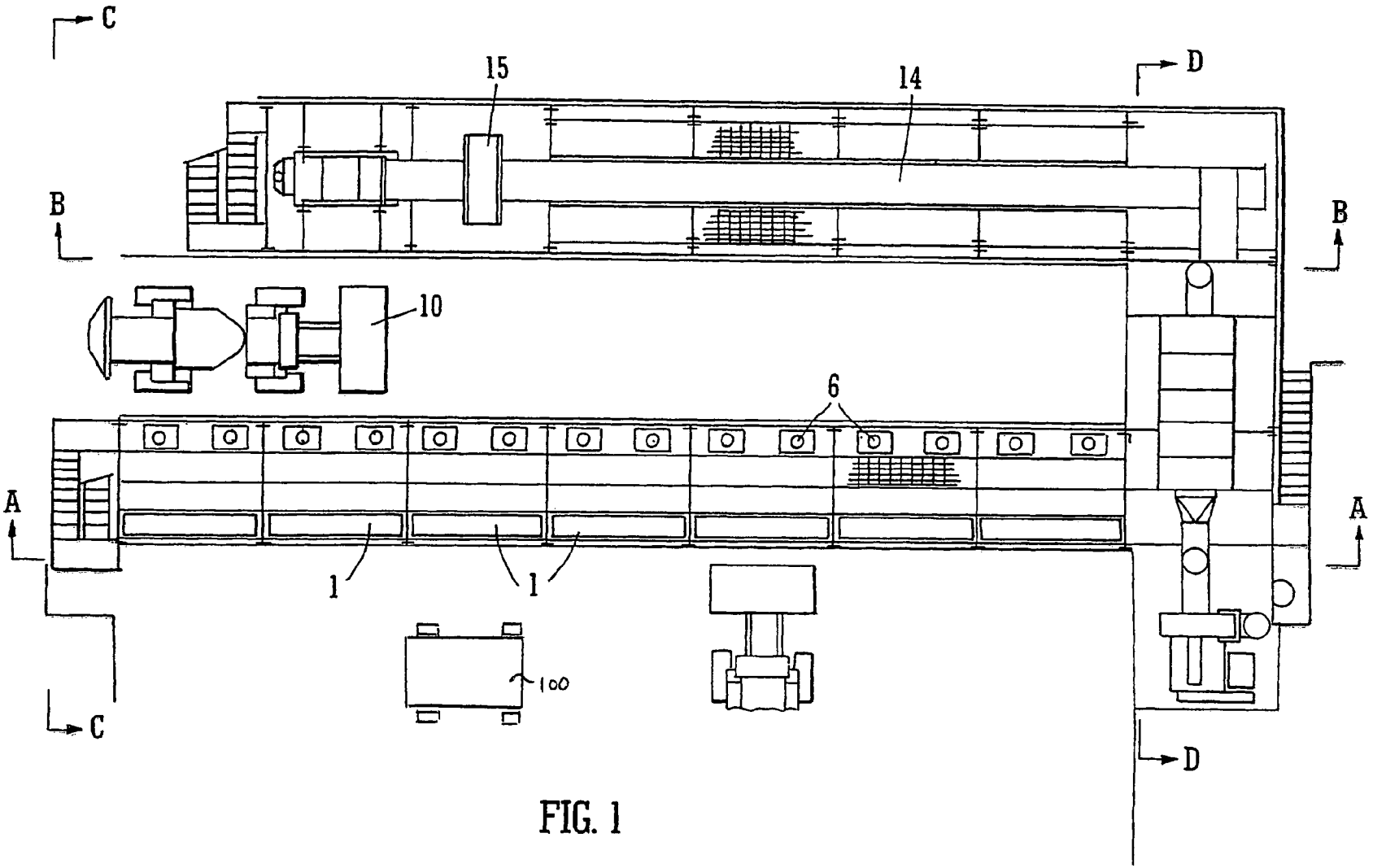
FIG. 1 is a plan view of apparatus of the invention.

As shown in FIG. 1, The apparatus of the invention comprises a bank of vessels 1 arranged in line. Each vessel 1 has a grid or screen 2 (FIG. 3) in its upper part, and a collection box 3 below. The grid 2 is made up sufficiently strong to support the weight of several bucket loads (approx.

Figure 3:
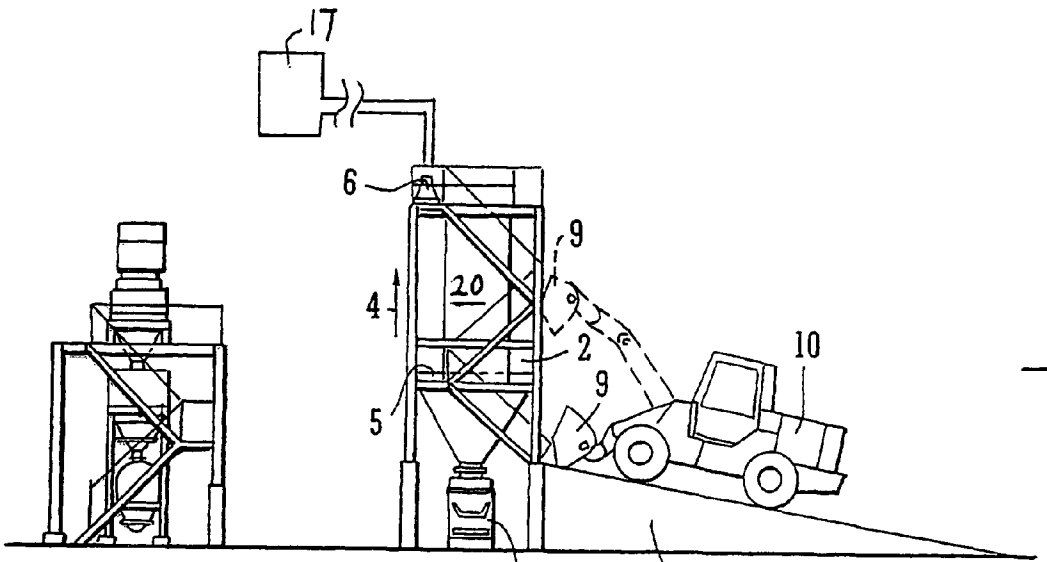
FIG. 3 is a side elevation of one vessel showing hot slag being loaded thereon.

IOMT) of hot slag. The grid 2 may be built up of layers of load bearing screen material, e.g. plates having vertically aligned holes. As shown in FIG. 3, air draft system 4 has an inlet 5 near the bottom of each vessel 1, and an outlet 6 in the roof. The draft is strong enough to draw air and dust particles. The bank has a motorised sealed door system comprising doors 8 dimensioned to receive the bucket 9 of a front end loading vehicle 10 and give general access to the grid 2. The doors 8 are located near the screen 2. A ramp 11 is present on one side of the hall, near the doors 8. A brush or tip up device, not shown, may be present to allow oversize material left on the screen 2 to be pushed out of the vessel on the opposite side of the ramp 11 and to be collected by the vehicle 10 for treatment.

Figure 2:
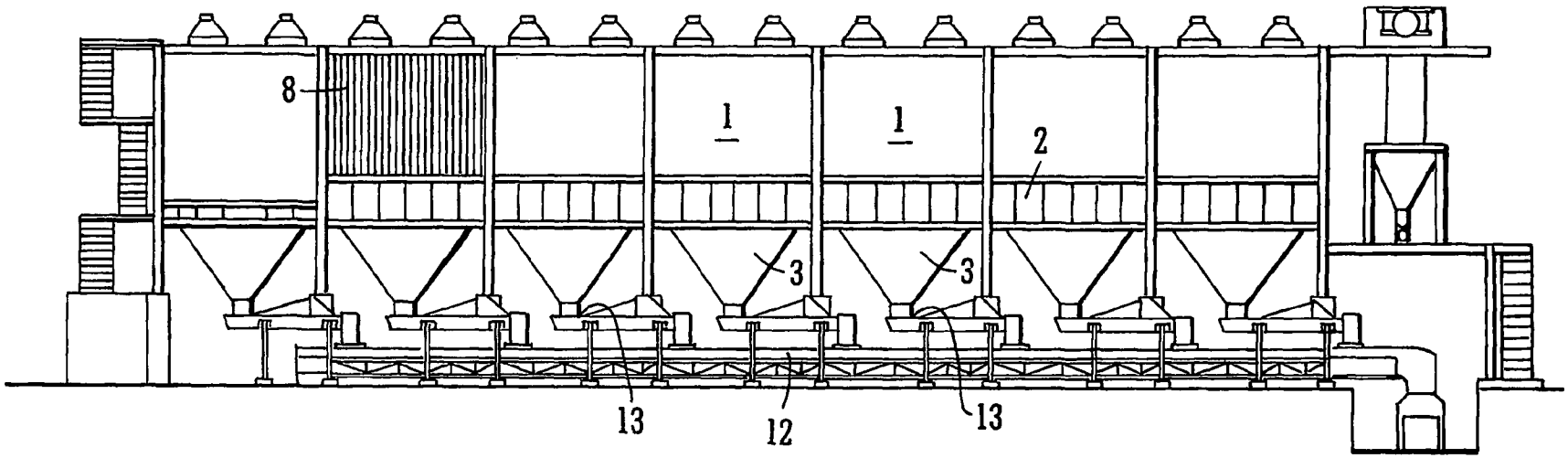
FIG. 2 is a side elevation of a bank of vessels.
Figure 4:
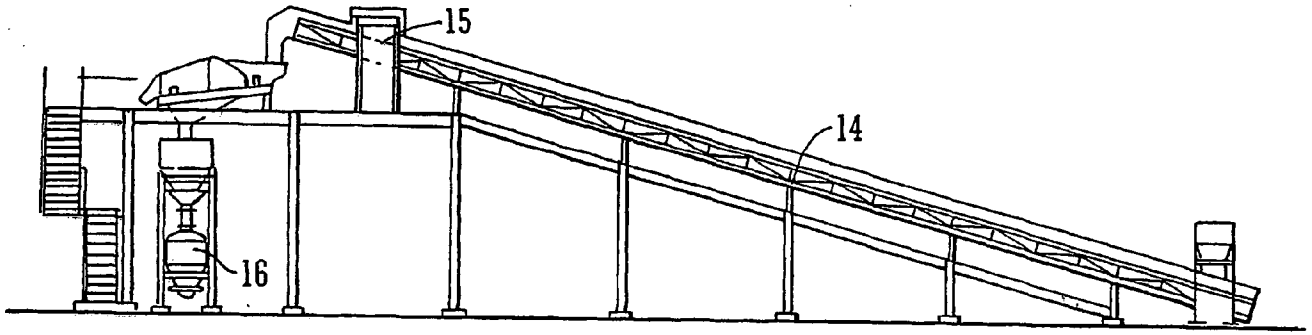
FIG. 4 is a side elevation taken on line IV-IV on FIG. 1.
Figure 5:
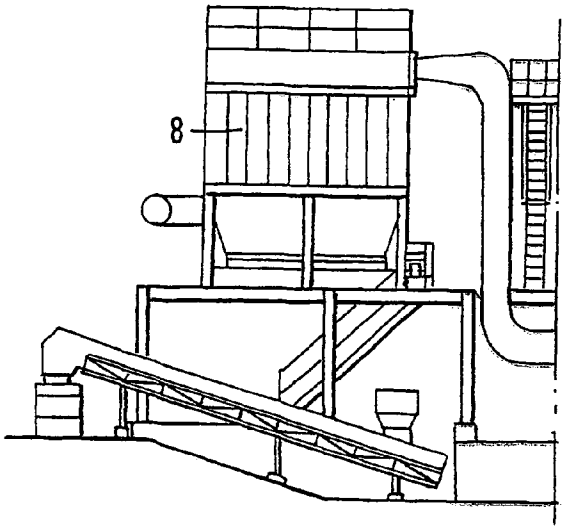
FIG. 5 is an end view of the apparatus taken on lines V-V on FIG. 1.

As shown in FIG. 2, a conveyor belt 12 travels below the boxes 3 of the vessels 1. The boxes have outlets 13 which open to drop received powder on to the belt 12. As shown in FIG. 4, the powder then passes on another conveyor 14 over a magnet 15 which retains the metallics. The metal-free powder then passes to a screen 16 to remove any oversize material. The particle size is chosen for injection of the powder into a furnace pneumatically, say up to about 10 mm in diameter.

The oversize material is tipped out of the vessels 1 shown in FIG. 1 and collected by the front end loader 10 travelling in the passage between the vessels 1 and the conveyor 14. This material is passed for treatment to recover the metallics and other materials.

The powder may be used instead of part or all of the normal furnace lime and is injected into a metallurgical furnace via a specialised pneumatic injection system designed for this purpose.

Figure 6:
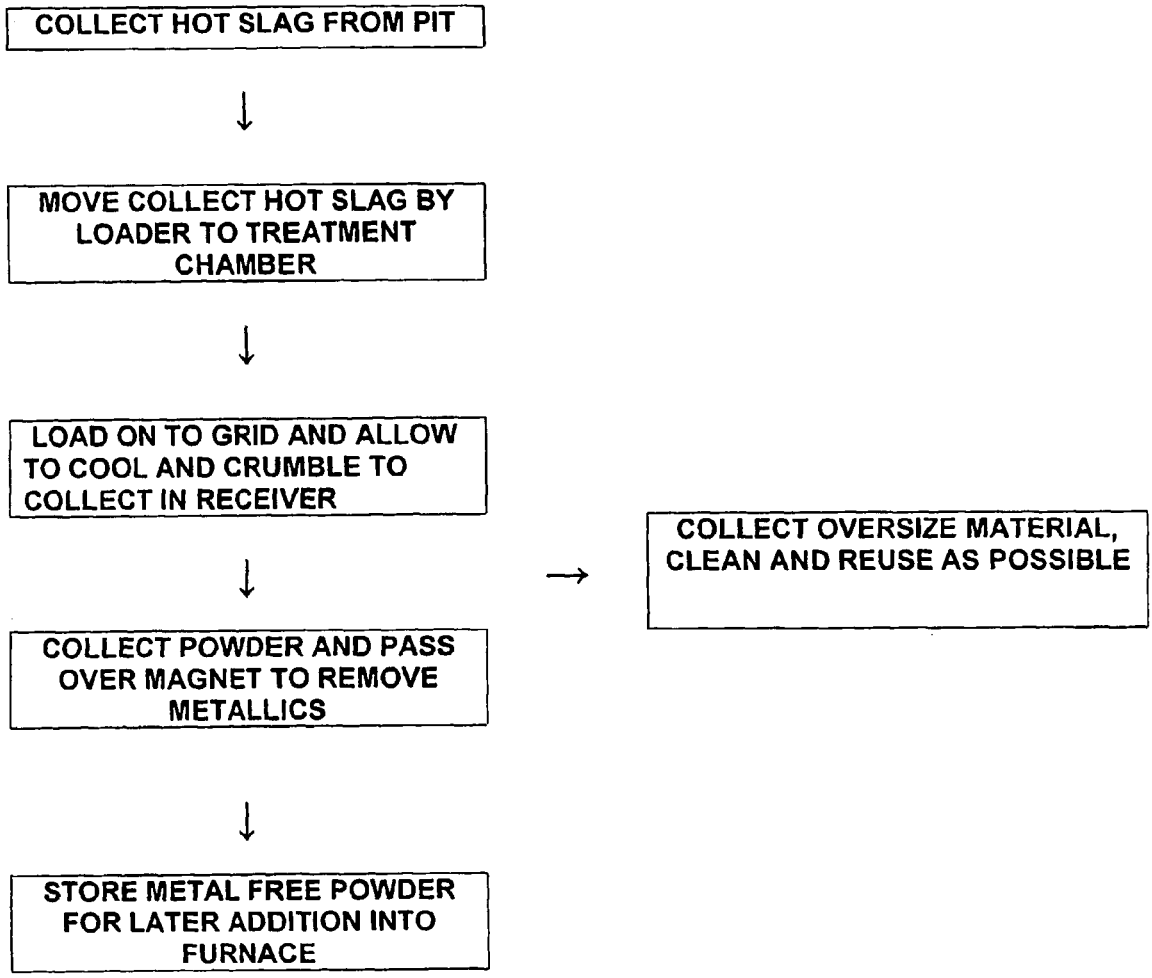
FIG. 6 is a schematic diagram of the overall method.

As shown in FIG. 6, in the method of the invention a front end loader extracts a bucket of hot slag material from the pit. This material made up of deposited slag; if used refractory bricks were deposited in the pit, these will have been fragmented and pieces will be included in the material. The loader then moves to one of the bank of the chambers, in the vessels 1. The doors 8 (FIG. 2) of the relevant vessel 1 are opened, and the loader moves the bucket 9 over the grid 2 in the chamber 20. The load is tipped on to the grid 2 (with the doors open) (there is air extraction to draw dust emissions into the chamber and not into the atmosphere) (FIG. 3). Air is passed up the chamber 20 and out of the outlet 6 to cool the material on the grid. The emerging air is passed to a baghouse 17 for cleaning in the usual way. Slag is loaded into the vessels. The slag cools and naturally crumbles into particles which fall through the grid 2 under gravity into the receiving hopper 3 below. Oversize material remains on the grid 2 and this includes metallics and other items, e.g. furnace slag or refractory pieces. This is tipped out of the vessel 1 by tipping the grid, for collection by the loader 10 for recovering and other treatment. Thus the bulk of the of the lime constituents has been collected, and the non-lime separated. The chambers 20 are filled in sequence (FIG. 1), and the recovered powder from all the hopper 3 is collected and deposited onto the underlying conveyor belt 12 (FIG. 2). Before the recovered powder can be used it is still necessary to screen and de-metallise it to avoid lumps which could block an injection system and to recover directly chargeable scrap metal. For this purpose, the powder is passed over a magnet 15 to remove metallics (FIG. 4). The treated powder is then passed over a screen 16 (FIG. 4) to remove oversize material and the screened material is passed to a silo for storage prior to addition, e.g. by injection, to a furnace. The powder has a particle size of up to about 10 mm. The lime component comprises by weight:

| | |
|---|---|
| CaO | 50-60% |
| MgO | 0-8% |

Dust may be collected from around the plant using vacuum systems such as vacuum truck 100 (FIG. 1) and this dust may be added to a hopper 3 for inclusion in the ladle slag powder passed to the conveyor 12 and as a means for disposal in the slag powder.

It will be seen that in the invention the slag has been moved in a dust free manner and without being wetted and has been treated for ready reuse as part of the lime charge for a metallurgical furnace. Little or no dust has been released into the atmosphere.

The invention is not limited to the apparatus or method just described. There may be more or less vessels. The vessel may have a different shape from that shown. A vehicle other than a front end loader may be used.

The invention claimed is:

1. A substantially dry and dust free method of recovering and using ladle slag in a furnace during steel making, the method comprising allowing hot slag to cool to powder form in a chamber of a vessel, the vessel providing a controlled environment in which the ladle slag is coolable, passing air across the hot ladle slag to cool it thereby causing the ladle slag to crumble to powder and collecting the ladle slag as powder in a receiver therefor and pneumatically injecting the powder into a furnace.

2. A method according to claim 1, including the step of locating the ladle slag on a screen in the chamber of a vessel having a controlled atmosphere and allowing the particles to fall into the receiver located below the screen.

3. A method according to claim 1, including separating metal which is entrapped in the powder prior to pneumatically injecting the powder into a furnace.

4. A method according to claim 2, including the step of passing sufficient air through the vessel to draw dust into the chamber, said dust being released whilst locating the slag on the screen.

5. A method according to claim 2, wherein the vessel has closable doors leading to the chamber and the method further including the steps of loading hot slag on to a front end loader, opening the doors and depositing the slag on to the screen.

6. A method according to claim 2, including the preliminary step of placing used refractory bricks and the like in a pit for the hot ladle slag, adding hot ladle slag to the pit, the heat of which fragmenting some of the bricks, and passing the ladle slag and the fragmented bricks to the vessel.

7. A method according to claim 1, including the step of collecting, by vacuum, dust in the controlled environment and adding it to a receiver.

8. A method according to claim 1, including the step of passing the so-collected powder over a magnet to separate magnetic metal therefrom prior to pneumatically injecting the powder into a furnace.

9. A method according to claim 2, including separating metal which is entrapped in the powder.

10. A method according to claim 2, including the step of passing the powder over a magnet to separate magnetic metal therefrom prior to pneumatically injecting the powder into a furnace.

* * * * *